US009212818B2

(12) United States Patent
Dreizler et al.

(10) Patent No.: US 9,212,818 B2
(45) Date of Patent: Dec. 15, 2015

(54) DISPLACEMENT METHOD FOR THE PRODUCTION OF A BURNER FABRIC MEMBRANE FOR A COOL FLAME BASE

(75) Inventors: Ulrich Dreizler, Hausen ob Verena (DE); Daniel Dreizler, Balgheim (DE)

(73) Assignee: Ulrich Dreizler, Hausen ob Verena (DE)

( * ) Notice: Subject to any disclaimer, the term of this patent is extended or adjusted under 35 U.S.C. 154(b) by 273 days.

(21) Appl. No.: 13/885,465

(22) PCT Filed: Aug. 23, 2011

(86) PCT No.: PCT/DE2011/001634

§ 371 (c)(1), (2), (4) Date: May 22, 2013

(87) PCT Pub. No.: WO2012/065583

PCT Pub. Date: May 24, 2012

(65) Prior Publication Data

US 2013/0232745 A1 Sep. 12, 2013

(30) Foreign Application Priority Data

Nov. 16, 2010 (DE) ..... 10 2010 051 415

(51) Int. Cl.
*F23D 14/14* (2006.01)
*B21F 27/18* (2006.01)
(Continued)

(52) U.S. Cl.
CPC ..... *F23D 14/14* (2013.01); *B21F 27/18* (2013.01); *B26F 1/14* (2013.01); *D03D 15/02* (2013.01); *F23D 14/02* (2013.01); *F23D 14/16* (2013.01); *F23D 14/46* (2013.01); *F23D 14/58* (2013.01); *F23D 2203/102* (2013.01); *F23D 2203/105* (2013.01); *F23D 2212/103* (2013.01); *F23D 2212/201* (2013.01); *F23D 2213/00* (2013.01); *F23D 2900/00019* (2013.01); *Y10T 83/0481* (2015.04)

(58) Field of Classification Search
CPC ..... B21F 27/18; B26F 1/14; D03D 15/02; F23D 14/02; F23D 14/14; F23D 14/16; F23D 14/46; F23D 2203/102; F23D 2203/105; F23D 2212/103; F23D 2212/201; F23D 2213/00; F23D 2900/00019; Y10T 83/0481
See application file for complete search history.

(56) References Cited

U.S. PATENT DOCUMENTS 5,088,919 A * 2/1992 De Bruyne et al. ..... 431/328
5,409,375 A * 4/1995 Butcher ..... 431/328
(Continued)

FOREIGN PATENT DOCUMENTS

CA 2117605 9/1993
DE 692 27 094 3/1999
(Continued)

OTHER PUBLICATIONS

International Search Report of PCT/DE2011/001634, date of mailing Sep. 14, 2012.
(Continued)

*Primary Examiner* — Alexander P Taousakis
(74) *Attorney, Agent, or Firm* — Collard & Roe, P.C.

(57) ABSTRACT

The invention relates to a production method for a burner fabric membrane (1) consisting of special steel fabric layers for burning fuel/air mixtures. Additional passages (4) in the fabric (8) are produced by the displacement of the fabric and the mouths of the passages protrude from the membrane surface (3).

5 Claims, 4 Drawing Sheets

Figure 1:
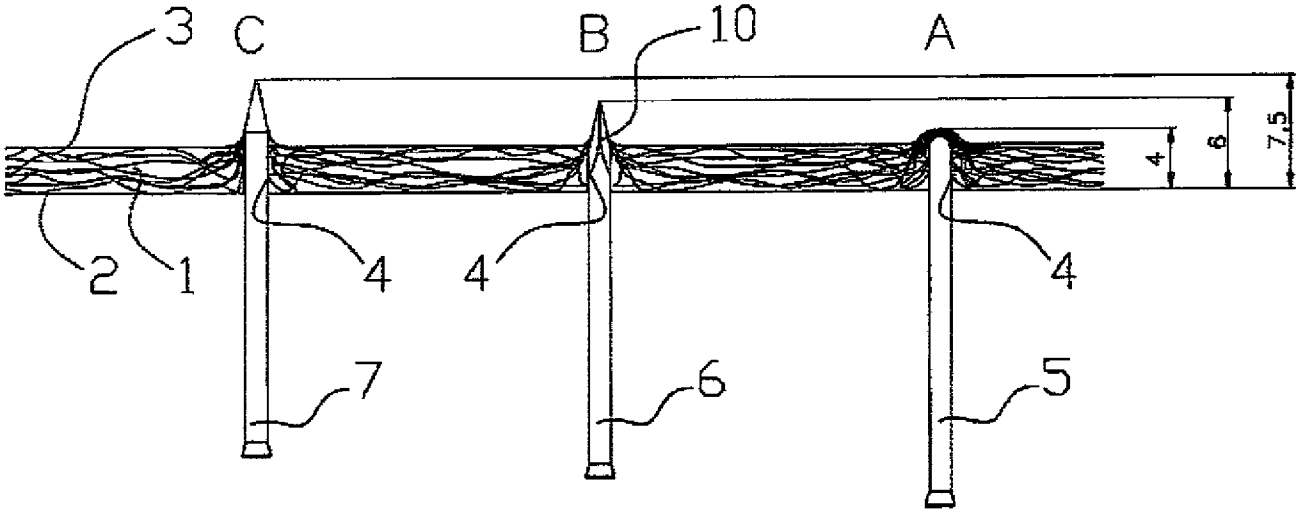

(51) Int. Cl.

| | |
|---|---|
| ***B26F 1/24*** | (2006.01) |
| ***F23D 14/02*** | (2006.01) |
| ***F23D 14/16*** | (2006.01) |
| ***F23D 14/46*** | (2006.01) |
| ***F23D 14/58*** | (2006.01) |
| ***B26F 1/14*** | (2006.01) |
| ***D03D 15/02*** | (2006.01) |

(56) References Cited

U.S. PATENT DOCUMENTS

| | | | |
|---|---|---|---|
| 5,447,666 | A | 9/1995 | LaFontaine |
| 5,496,171 | A | 3/1996 | Ozawa et al. |
| 6,428,312 | B1 | 8/2002 | Smelcer et al. |
| 6,607,998 | B1 | 8/2003 | Lambert et al. |
| 8,887,863 | B2 | 11/2014 | Okabe et al. |

FOREIGN PATENT DOCUMENTS

| | | | |
|---|---|---|---|
| DE | 693 22 622 | | 5/1999 |
| DE | 198 47 042 | | 4/2000 |
| DE | 698 03 085 | | 7/2002 |
| EP | 0 549 476 | | 6/1993 |
| JP | H 6-94224 | A | 4/1994 |
| JP | H 9-229314 | A | 9/1997 |
| JP | 2000-55316 | A | 2/2000 |
| WO | WO 01/86204 | | 11/2001 |

OTHER PUBLICATIONS

International Preliminary Report on Patentability of PCT/DE2011/001634, May 16, 2013.

Office Action of U.S. Appl. No. 13/885,458, mailed Jul. 30, 2015.

* cited by examiner

DISPLACEMENT METHOD FOR THE PRODUCTION OF A BURNER FABRIC MEMBRANE FOR A COOL FLAME BASE

CROSS REFERENCE TO RELATED APPLICATIONS

This application is the National Stage of PCT/DE2011/001634 filed on Aug. 23, 2011, which claims priority under 35 U.S.C. §119 of German Application No. 10 2010 051 415.2 filed on Nov. 16, 2010, the disclosure of which is incorporated by reference. The international application under PCT article 21(2) was not published in English.

STATE OF THE ART

The invention proceeds from a method for the production of burner woven fabric membrane in accordance with the species of the main claim (characteristics a, b, c). Because of the most varied use of such burner woven fabric membranes, different production methods of such membranes are also known, accordingly, whereby this involves metal woven fabric layers or fiber nonwovens composed of inorganic material, in other words composed of stainless steel or the like, which are connected with one another. These metal woven fabric membranes are exposed to significant stresses, particularly with regard to the combustion that takes place on the membrane, in other words the flame field that is present there, whereby furthermore, there is also the risk that flash-back of the fire through the membrane to the space located upstream from the membrane could take place, because a premixed fuel/air mixture is present, which is capable of ignition and therefore of explosion.

In DE 198 47 042 B4, a highly porous burner mat for gas and/or oil burners is known, which consists of ceramic and/or metallic fibers and/or fiber segments that are permanently connected with one another, and has locations with different gas permeability in the form of openings distributed over the mat plane, whereby the burner mat is structured in two layers, in any case, and the passages (openings) are disposed in only one of the two layers, so that as a result, the passages as a whole are configured only as dead-end holes. These dead-end holes then again have different cross-sections; in any case, the goal of the patent application here is to prevent flash-back of the flame or of the fire, and nevertheless to keep the membrane resistance within a specific size range for advantageous flame stability, so that "the flame stability is clearly improved at reduced flow resistance" (page 3 [0017]). On the basis of the dead-end holes that separate the two sides of the membrane, the resistance of the membrane is allegedly lowered, and therefore the possible power range can be changed. However, this known solution always requires, in contrast to the invention, two membrane layers that are connected with one another, as well as adaptation of the partial passages to the need, in each instance.

Production of such a burner woven fabric membrane with a great number of passages having different diameters, suitable for surface combustion, is known from the translation DE 692 27 094 T2 of the European Patent 0549476 B1, whereby, however, the object demonstrates the disadvantage that the orifices of the passages have smooth cut edges at the cut locations, on the fire side, i.e. at the exit locations of the fuel/air mixture toward the combustion chamber, as the result of the production of this known membrane by means of drilling, punching, or cutting.

In yet another membrane production method, which must, however, be assigned to a different species, DE 698 03 085 T2, a fiber web is needled and then compressed. It is not supposed to be sintered and is therefore of a different species.

In yet another production method of a burner woven fabric membrane, known from DE 693 22 622 12, a slight pressure drop with a uniform combustion process of the gases flowing through is achieved over the entire burner surface, on the basis of the porosity of the metal fiber plate. "As one result, it is" achieved "that no specific surface regions deteriorate prematurely on the basis of overload or overheating, as compared with other regions, on the basis of non-homogeneities of the porosity," which would lead to under-controllable preferential gas stream paths or combustion regions. In the production of the metal fiber plate, a regular pattern of transverse holes or transverse passages is produced with "completely delimited cylindrical dimensions" and a correspondingly free pass-through surface area between 5% and 35% of the top surface area. These transverse passages are produced by means of "embossing punches with punching pins." In any case, the power range is supposed to be "tremendously expanded" an the basis of these additional passages, at low CO and NOx (page 3, paragraph 2), and low occurrence of resonances (page 7) in the gas stream. Here, too, smooth exit edges of the passages are involved, which are produced on the root side of the flames by way of punching pins.

Disadvantages of the State of the Art and Underlying Task

Despite the existing attempts to expand the power range by means of the passages for the fuel/air mixture, to reduce the NOx portion, and to prevent noise resonances, it has only been possible to achieve this in very restricted manner up to the present, on the basis of the method of production of the passages that has been selected, in each instance. In the case of a smooth cut of the passage orifices that results from punching or cutting, it has not been possible until now, in any case, to keep the optimized NOx portions constant in connection with a variable power range, and, above all, to prevent the occurrence of resonances.

The Invention as a Solution of the Task and its Advantages

The invention is based on the task of developing a method for the production of a burner woven fabric that avoids these disadvantages.

The underlying task is accomplished, according to the invention, by means of the characterizing features of claim 1. On the basis of the displacement of woven fabric material by way of mandrels or pins, nub-like outward displacement of woven fabric material occurs on the flame side, and also because of the flow conditions of the fuel/air mixture through the passages, leads to cool flame roots, so that these remain cool during firing operation. With a burner woven fabric membrane produced in this manner, i.e. maintaining the woven fabric to a great extent, by means of displacement using mandrels or pins, a cool flame root is achieved, in advantageous manner, so that on the one hand, when using such a burner woven fabric, the power range suitable for its use can be significantly increased, and on the other hand, the flame roots remain cool. In this way, the result is therefore achieved that despite the change in power, an existing low NOx is maintained, and that above all, prevention of vibrations with the consequence of resonances in the gas/air stream is achieved, which are known to be able to lead to extraordinary noise development. The orifices of the passage are formed, according to the invention, by fibers of the woven fabric that are displaced outward, so that a kind of fraying of the orifices of the passage could also exist.

According to an advantageous embodiment of the invention, at least two woven fabric layers or fiber tiles, whereby these woven fabric layers or fiber nonwovens are disposed one on top of the other (also intersecting) and sintered to one another. Such arrangement of woven fabric layers or fiber tiles on top of one another is actually known (DE 198 47 042 B4), but is important with regard to the invention in that a displacement of membrane woven fabric to achieve the passages is not known or of importance there. The different dead-end hole cross-sections claimed there are not aimed at in the present invention.

According to the invention, the configuration of the displacer side (front side) of the mandrels or pins can determine the orifices of the passages (frayed parts) in the flow direction. The essential difference as compared with the known production methods consists, in the case of the invention, of at least partial displacement of membrane woven fabric for the production of the additional passages. In this regard, the configuration of the displacer side of the mandrels or pins has a decisive influence on the shape of the orifices of the passages. Accordingly, this configuration is of particular importance. Thus, according to an additional embodiment of the invention, the membrane surface is deformed in nub-like or mushroom-like manner after displacement.

By means of the shape of the mandrels or pins, non-uniform thinning of the woven fabric in the region of the passage exit can be brought about, according to the invention. This has an influence, above all, on the advantages of the invention being aimed at, for example also achieving a cool flame root, which is a prerequisite for the other stated advantages.

According to an additional embodiment of the invention, the material of the membrane is partially perforated during displacement of the woven fabric material or fiber material by the mandrels or pins. During this perforation, the shape of the orifices of the passage can be determined, above all, whereby it should be taken into consideration that material cut-offs occur even within the passages, in known manner, which, however, relates only to dead-end holes (DE 198 47 042 B4, FIG. 13), so that it cannot be precluded that woven fabric parts that spring back there counteract sound formation within the passage, although such an effect is not mentioned and also cannot be assumed, since this involves a two-layer membrane having corresponding holes in only one of these layers. As a result, the passage will not be able to produce any resonances any longer, as the result of de-tuning caused by the frayed parts.

According to an embodiment of the production method, the working side of the mandrels or pins has a round or partially round cross-section and/or narrow in the working direction, in conical or pyramidal shape. Not only in the embodiment of the invention that describes only thinning of the woven fabric, but also in the case of perforation of the membrane material, these different shapes on the working side of the mandrels and pins can be advantageous.

Further advantages and advantageous embodiments of the invention can be derived from the following description, the drawing, and the claims.

DRAWING

An exemplary embodiment of the object of the invention is shown in the drawing and will be described in greater detail below.

Figure 2:
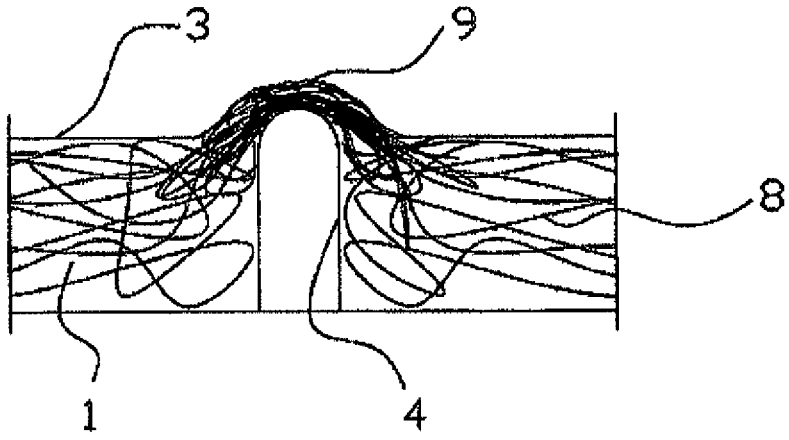
Figure 4:
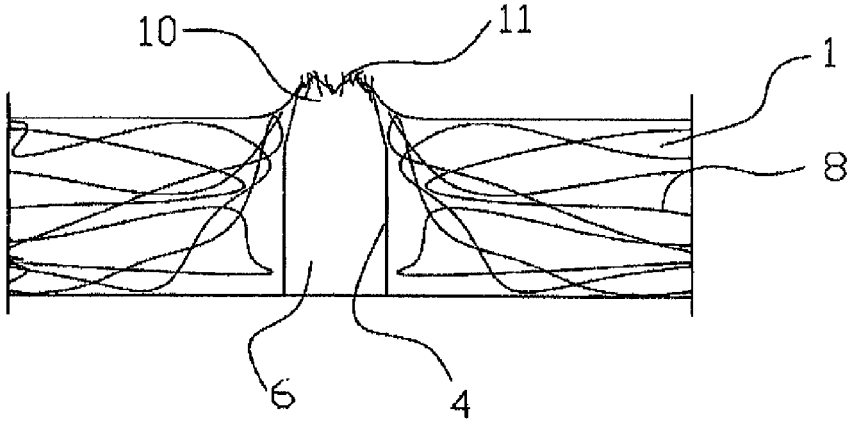
Figure 6:
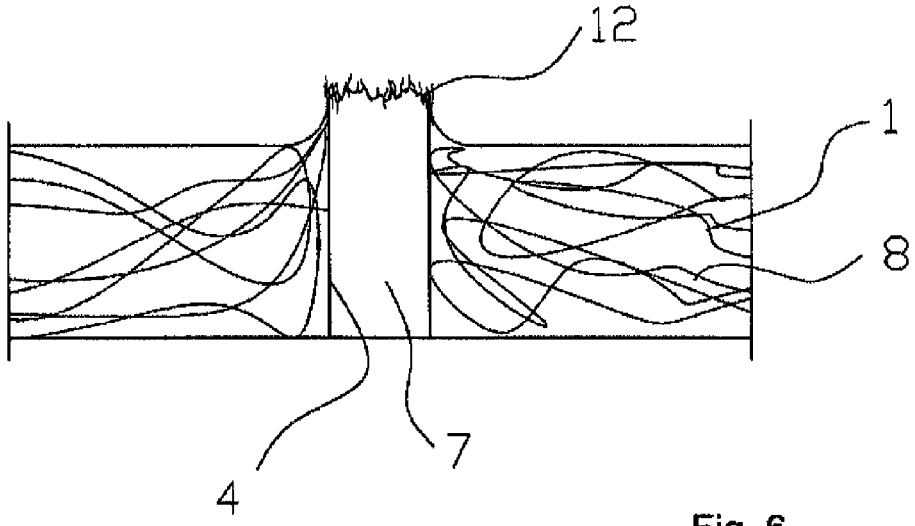

The figures show:

FIG. 1 three different production methods A, B, and C, using a membrane shown in longitudinal section;

FIG. 2+3 a detail of the membrane on an enlarged scale, according to the production method A;

FIG. 4+5 a detail of the membrane on an enlarged scale, according to the production method B; and FIG. 6+7 a detail of the membrane on an enlarged scale, according to the production method C.

DESCRIPTION OF THREE EXEMPLARY EMBODIMENTS

In FIG. 1, a membrane, which consists, in known manner, of heat-resistant, in other words refractory woven fabric made of inorganic fibers, particularly stainless steel, is shown in longitudinal section. This woven fabric has a mixture of fuel and air flowing through it during use of such a membrane, whereby the flame field that combusts the fuel/air mixture occurs on the burner side 3, which faces away from the inflow side 2. In the use of such known membranes, it is also known to connect the spaces separated by the membranes 1 by way of additional passages 4. Fuel/air mixture can also flow by way of these additional passages, so that aside from the flame field on the side 3, a field with higher flames can occur. The shape and, in particular, the orifice of these passages 4 is decisive for the shape and the temperature of the flames. According to the invention, these passages are supposed to occur by means of displacement of the fiber material, in other words not by means of cutting up or drilling through the membrane, whereby, of course, this displacement has an effect on the shape of the orifices. In FIG. 1, the membrane 1 is shown in longitudinal section, through which the individual passages 4 run. Also, in FIG. 1, the displacement tools in the form of pins 5, 6, and 7 are shown in an outside view and disposed in the passages 4, so that after retraction of these pins, the passages 4 as such remain, as shown in FIGS. 2 to 7. The pins 5, 6, and 7 are driven by a machine, not shown, in order to achieve displacement of fibers, according to the invention, in the membrane 1.

In Example A (FIG. 2 and FIG. 3), the pin 5 brings about displacement within the membrane 1, which leads to nubs on the combustion side 3 of the membrane 1. The nubs project beyond the exit surface by 0.5 to 1.5 mm in the selected example.

In Example B (FIG. 4 and FIG. 5), the membrane 1 is partially perforated by the tool 6, and the frayed parts have a projection of 0.5 to 1 mm.

In the third example C (FIG. 6 and FIG. 7), the tool 7 perforates the membrane 1, and the frayed parts have a projection of 0.7 to 2 mm.

Figure 3:
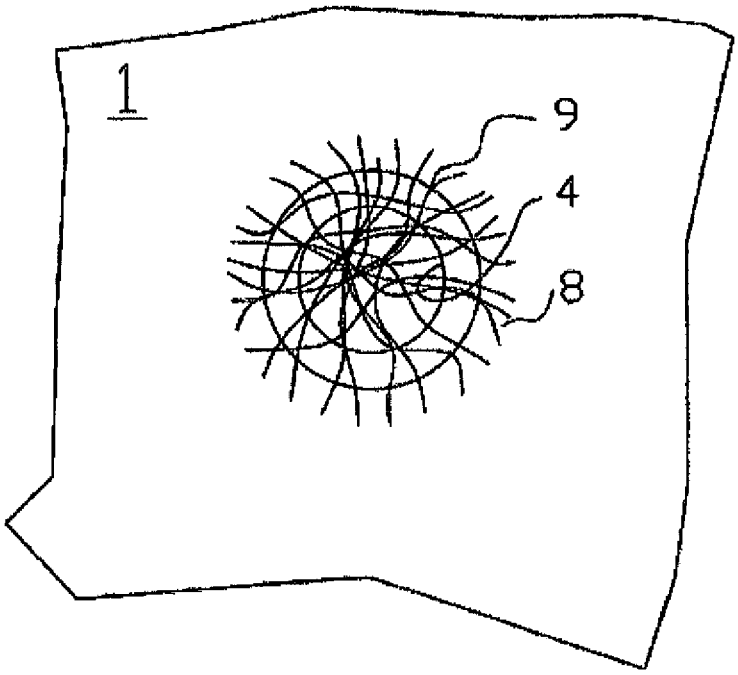

In the first exemplary embodiment A, shown in FIG. 2 and FIG. 3, the pin 5 has displaced the membrane 1 in the region of the passage 4, whereby the fibers 8 of the woven fabric compact at the orifice 9 of this passage and are pulled apart, as is evident in FIG. 3. The orifice 9 as such is maintained for flow of the fuel/air mixture through it, and this leads to a cool root of the related flame during use of the membrane.

Figure 5:
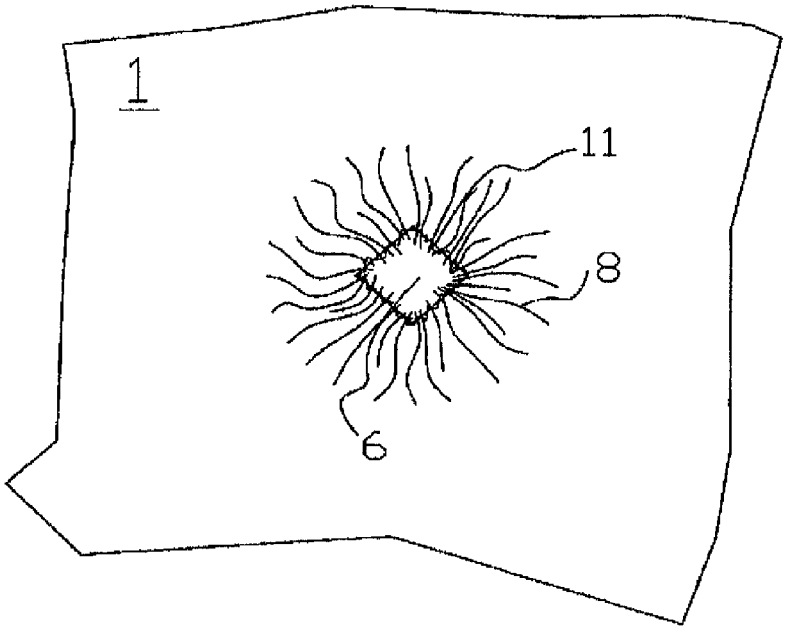

In the second exemplary embodiment B, shown in FIG. 4 and FIG. 5, the pin 6 has partially perforated the membrane 1 with its tip. The tip 10 of the pin 6 is configured in pyramid-like manner, as can be seen from FIG. 1 in combination with FIG. 5, whereby in every case, only partial perforation of the membrane 1 by the pin 6 has taken place. The orifice 11 of the passage 4 is frayed as the result of displacement of the woven fabric fibers.

Figure 7:
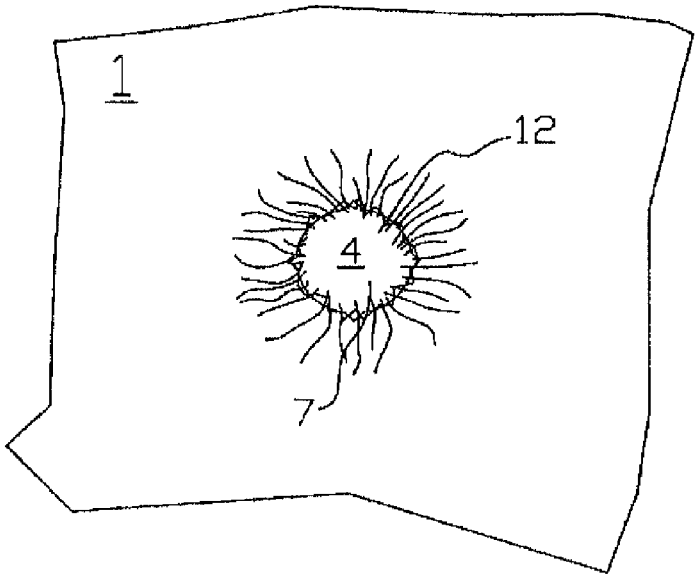

In the third exemplary embodiment C, shown in FIG. 6 and FIG. 7, the pin 7 has already completely perforated the membrane 1, so that the orifice 12 of the passage 4 has approximately the diameter of the pin 7. According to the invention, a frayed orifice 12 occurs by means of this displacement of the fibers 8 for production of the passage 4, in order to obtain a cool flame root when using such a membrane.

All of the characteristics presented in the specification, the claims below, and shown in the drawing can be essential to the invention not only individually but also in any desired combination with one another.

REFERENCE SYMBOL LIST

1 membrane
2 inflow side
3 burner side
4 passages (additional)
5 pins
6 pins
7 pins
8 fibers (woven fabric)
9 orifice
10 tip
11 orifice
12 orifice

The invention claimed is:

1. Method for production of a burner woven fabric membrane (1), a) wherein the membrane (1) comprises metal woven fabric layers (8) composed of inorganic material, b) wherein the membrane permits a premixed and ignitable fuel/air mixture, which is combustible on the surface of the membrane (1), to flow through the woven fabric (8) of this membrane (1), and c) with a connection of the two sides (2, 3) of the membrane (1), aside from by way of the woven fabric itself, by way of additional passages (4) in the woven fabric (8) for the fuel/air mixture, as an additional pass-through for the premixed fuel/air mixture, wherein d) these additional passages (4) are produced by means of at least partial displacement of membrane woven fabric (8), e) wherein this displacement takes place by means of mandrels or pins (5, 6, 7) that penetrate into the membrane woven fabric (8), wherein the orifices of the additional passages (4) are formed by penetration of the mandrels or pins into the membrane woven fabric, and f) wherein after displacement, the orifices (9, 11, 12) of the passages project out of the surface (3), on the surface (3) of the membrane (1) that faces away from the inflow side (2) of the passages, in the flow direction of the fuel/air mixture, or wherein fibers exit from the walls of the passages, toward their inside.

2. Production method according to claim 1, wherein at least two woven fabric layers or fiber nonwovens are used in the production of the membrane, and wherein these woven fabric layers or fiber nonwovens are disposed one on top of the other and sintered to one another.

3. Production method according to claim 1, wherein after displacement of the woven fabric (8), the orifices (9) of the passage (4) project out of the membrane surface (3), in nub-like or mushroom-like manner.

4. Production method according to claim 1, wherein during displacement of the woven fabric material or fiber material by the mandrels or pins (6, 7), the material of the membrane (1) is partially perforated.

5. Production method according to claim 1, wherein the working side of the mandrels or pins (5, 6, 7) has a round (5) or partially round cross-section and/or narrow in the working direction (6, 7), i.e. is configured in cone shape (7) or pyramid shape (6).

* * * * *